US011371181B2

(12) United States Patent
Yu et al.

(10) Patent No.: US 11,371,181 B2
(45) Date of Patent: Jun. 28, 2022

(54) DRYER APPLIANCE AND VENTILATION ASSEMBLY

(71) Applicant: Haier US Appliance Solutions, Inc., Wilmington, DE (US)

(72) Inventors: Zhiquan Yu, Mason, OH (US); Robert V. MacDonald, III, Simpsonville, KY (US); Pablo Enrique Soto Rodriguez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 133 days.

(21) Appl. No.: 16/553,473

(22) Filed: Aug. 28, 2019

(65) Prior Publication Data

US 2021/0062400 A1 Mar. 4, 2021

(51) Int. Cl.

| | |
|---|---|
| ***D06F 58/10*** | (2006.01) |
| ***D06F 58/20*** | (2006.01) |
| *D06F 103/36* | (2020.01) |
| *D06F 105/24* | (2020.01) |
| *D06F 58/02* | (2006.01) |

(52) U.S. Cl.

CPC ..... *D06F 58/10* (2013.01); *D06F 58/20* (2013.01); *D06F 58/02* (2013.01); *D06F 2103/36* (2020.02); *D06F 2105/24* (2020.02)

(58) Field of Classification Search

CPC .. D06F 58/10; D06F 2103/36; D06F 2105/24; D06F 58/20; D06F 58/02

See application file for complete search history.

(56) References Cited

U.S. PATENT DOCUMENTS

| | | | | |
|---|---|---|---|---|
| 2,505,631 | A * | 4/1950 | Webster | F16L 37/54 285/5 |
| 3,081,555 | A * | 3/1963 | Stratman | D06F 58/22 34/79 |
| 4,069,596 | A | 1/1978 | Sisler | |
| 5,066,050 | A | 11/1991 | Kretchman | |
| 8,191,388 | B2 * | 6/2012 | Kim | D06F 58/26 68/20 |
| 2005/0198851 | A1 * | 9/2005 | Tomochika | D06F 58/20 34/74 |
| 2007/0227031 | A1 * | 10/2007 | Yoon | F04D 29/4226 34/242 |
| 2019/0154154 | A1 * | 5/2019 | Weaver | B64D 33/04 |

FOREIGN PATENT DOCUMENTS

| | | | |
|---|---|---|---|
| KR | 20030003922 | A * | 1/2003 |
| KR | 100408062 | B1 | 12/2003 |
| WO | WO2018171526 | A1 | 9/2018 |

* cited by examiner

*Primary Examiner* — Jessica Yuen
(74) *Attorney, Agent, or Firm* — Dority & Manning, P.A.

(57) ABSTRACT

A dryer appliance or ventilation assembly, as provided herein, may include an impeller, a housing, a front duct, and a sealing gasket. The impeller may be rotatable about an axial direction to urge a flow of air. The housing may enclose the impeller within a cabinet. The housing may define an entrance upstream of the impeller to permit air into the housing. The front duct may include an attachment collar defining a duct outlet. The attachment collar may be received within the entrance. The sealing gasket may be radially positioned between the attachment collar and the entrance.

20 Claims, 10 Drawing Sheets

DRYER APPLIANCE AND VENTILATION ASSEMBLY

FIELD OF THE INVENTION

The present subject matter relates generally to dryer appliances and more particularly to ventilation assemblies for dryer appliances.

BACKGROUND OF THE INVENTION

Dryer appliances generally include a cabinet with a drum rotatably mounted therein. A motor can selectively rotate the drum during operation of the dryer appliance (e.g., to tumble articles located within a chamber defined by the drum). Dryer appliances also generally include a heater assembly that passes heated air through the chamber of the drum in order to dry moisture laden articles disposed within the chamber.

In order to circulate heated air, certain dryer appliances include a ventilation assembly having an impeller to rotate about a drive rod within a housing. During operation of the dryer appliance, the impeller urges a flow of heated air into the chamber of the drum. Such heated air absorbs moisture from articles disposed within the chamber. The impeller also urges moisture laden air out of the chamber through a vent. The vent can be connected to household ductwork that directs the moisture laden air outdoors.

One issue that exists with dryer appliances is the possibility of air leaks, for example, in a duct or conduit of the ventilation assembly. Such air leaks may release heat to the ambient environment and reduce the efficacy of the impeller. These issues may be especially pronounced near the impeller.

Air leaks can often be formed at the connection point of two or more discrete portions (e.g., ducts, housings, or conduits) of the ventilation assembly. In order to address this concern, some existing dryer appliances have provided axial seals that are sandwiched between the tips of separate conduits. This may create additional issues, though. As an example, construction or assembly of the dryer appliance may be made more difficult since alignment must be ensured between axial seals. As another example, lint or debris may collect on or near the axial seal. Over time, air restrictions may be formed by the collected lint or debris. Such restrictions can decrease the effective operating size of the passages through which air flows during operation. Furthermore, restrictions can prevent proper airflow, thereby increasing drying cycle time, reducing drying power efficiency, or reducing the final dryness of articles in the dryer appliances.

Accordingly, a dryer appliance with features for improving air flow through the dryer appliance would be useful. In particular, a dryer appliance having features for preventing air leaks or restrictions within the ventilation assembly would be useful. Additionally or alternatively, it may be advantageous to provide a dryer appliance with features for improving the ease of construction or assembly, for instance, at a ventilation assembly.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, an impeller, a housing, a front duct, and a sealing gasket. The cabinet may define a vent. The drum may be rotatably mounted within the cabinet. The drum may define a chamber for receipt of articles for drying. The impeller may be rotatable about an axial direction to urge a flow of air from the chamber of the drum to the vent of the cabinet. The housing may enclose the impeller within the cabinet. The housing may define an entrance upstream of the impeller to permit air into the housing. The front duct may extend along a flow path between the drum and the housing. The front duct may include an attachment collar defining a duct outlet. The attachment collar may be received within the entrance. The sealing gasket may be radially positioned between the attachment collar and the entrance.

In another exemplary aspect of the present disclosure, a ventilation assembly is provided. The ventilation assembly may include a motor, an impeller, a housing, a front duct, and a sealing gasket. The motor may include a drive shaft. The impeller may be in mechanical communication with the motor to motivate rotation of the impeller about an axial direction. The impeller may be rotatable about the axial direction to urge a flow of air from a drum of the dryer appliance. The impeller may define a circumferential perimeter about the axial direction. The housing may include a cylindrical portion and an inlet cover. The cylindrical portion may define a volute within which the impeller is enclosed. The inlet cover may be selectively mounted to the cylindrical portion and define the entrance opposite the drive shaft to permit air into the housing. The front duct may extend along a flow path between the drum and the housing. The front duct may include an attachment collar that defines a duct outlet. The attachment collar may be received within the entrance. The sealing gasket may be radially positioned between the attachment collar and the entrance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
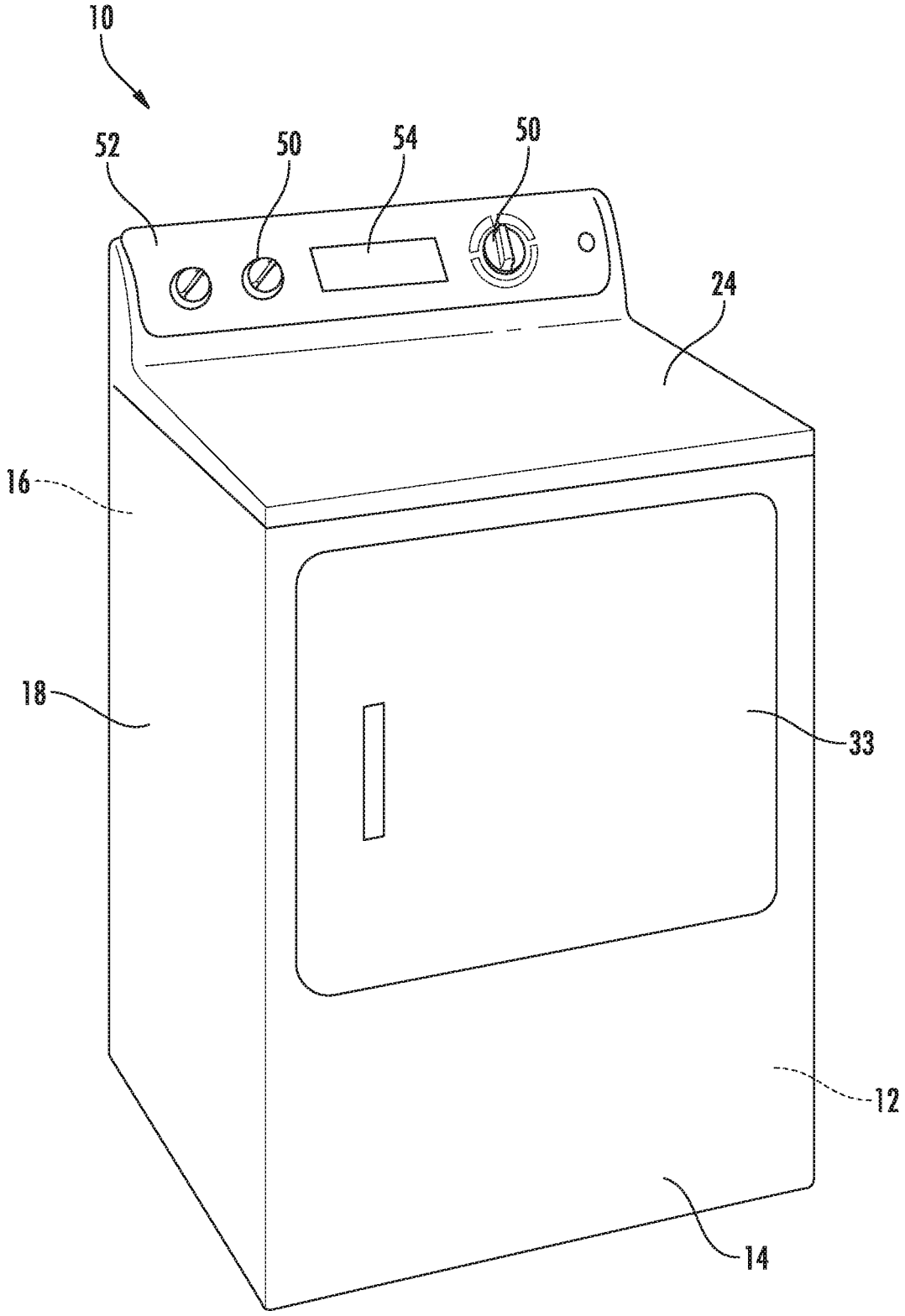
FIG. 1 provides a perspective view of a dryer appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The term "article" may refer to but need not be limited to fabrics, textiles, garments (or clothing), and linens.

Figure 2:
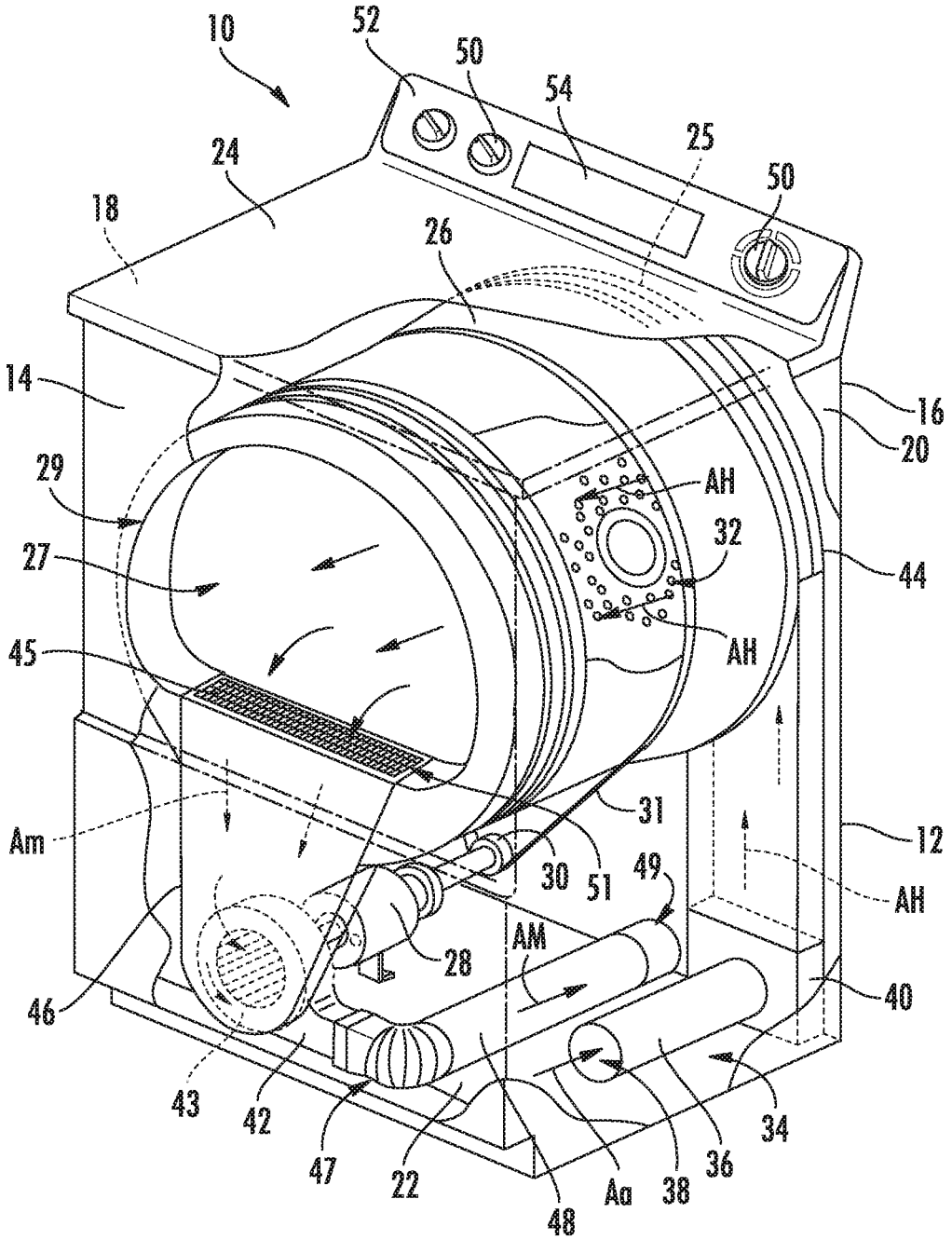
FIG. 2 provides a perspective view of the exemplary dryer appliance of FIG. 1 with a portion of a cabinet of the exemplary dryer appliance removed to reveal certain internal components of the exemplary dryer appliance.

FIGS. 1 and 2 illustrate a dryer appliance 10 according to exemplary embodiments of the present disclosure. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is a gas dryer appliance with a combustion chamber 36. In alternative exemplary embodiments, dryer appliance 10 may be an electric dryer appliance with electric heating elements replacing combustion chamber 36.

Dryer appliance 10 generally includes a cabinet 12 having a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation (e.g., about a substantially horizontal axis). Drum 26 is generally cylindrical in shape and defines a chamber 27 for receipt of articles for drying.

Drum 26 also defines an opening 29 for permitting access to the chamber 27 of drum 26. Opening 29 of drum 26, for example, permits loading and unloading of clothing articles and other fabrics from chamber 27 of drum 26. A door 33 is rotatably mounted at opening 29 and selectively hinders access to chamber 27 of drum 26 through opening 29.

Drum 26 includes a rear wall 25 rotatably supported within cabinet 12 by a suitable fixed bearing. Rear wall 25 can be fixed or can be rotatable. In some embodiments, a motor 28 is provided in mechanical communication with the drum 26 (e.g., motivate rotation of the drum 26). For example, the motor 28 may rotate the drum 26 about the horizontal axis through a pulley 30 and a belt 31. In additional or alternative embodiments, the motor 28 is part of a ventilation assembly. For example, the motor 28 may be in mechanical communication with a fan or air handler 42 such that motor 28 rotates an impeller 43 (e.g., a centrifugal impeller) of air handler 42. Air handler 42 is configured for drawing air through chamber 27 of drum 26 (e.g., in order to dry articles located therein), as discussed in greater detail below.

During use, drum 26 may receive heated air that has been heated by a heater assembly 34 (e.g., in order to dry damp articles disposed within chamber 27 of drum 26). In some embodiments, heater assembly 34 includes a combustion chamber 36. As discussed above, during operation of dryer appliance 10, motor 28 rotates drum 26 and impeller 43 of air handler 42 such that air handler 42 draws air through chamber 27 of drum 26 when motor 28 rotates impeller 43. In particular, ambient air, shown with arrow $A_a$, enters combustion chamber 36 via an inlet 38 due to air handler 42 urging such ambient air $A_a$ into inlet 38. Such ambient air $A_a$ is heated within combustion chamber 36 and exits combustion chamber 36 as heated air, shown with arrow $A_h$. Air handler 42 draws such heated air $A_h$ through a back duct 40 to drum 26. The heated air $A_h$ enters drum 26 through a plurality of holes 32 defined in rear wall 25 of drum 26.

Within chamber 27, the heated air $A_h$ can accumulate moisture, such as from damp articles disposed within chamber 27. In turn, air handler 42 draws moisture laden air, shown as arrow $A_m$, through a screen filter 45 (e.g., positioned within a duct inlet 51) which may trap lint particles. Such moisture laden air $A_m$ then enters a front duct 46 (e.g., through duct inlet 51) and is passed through air handler 42 to an exhaust duct 48. From exhaust duct 48, such moisture laden air $A_m$ passes out of clothes dryer 10 through a vent 49 defined by cabinet 12.

Front duct 46 and exhaust duct 48 form a conduit 47 that extends between and connects chamber 27 of drum 26 and vent 49. Conduit 47 places chamber 27 of drum 26 and vent 49 in fluid communication in order to permit moisture laden air $A_m$ to exit dryer appliance 10. Air handler 42 is in fluid communication with conduit 47, and impeller 43 of air handler 42 is positioned within conduit 47.

A cycle selector knob 50 is mounted on a cabinet backsplash 52 and is in communication with a controller 54. Signals generated in controller 54 operate motor 28 and heater assembly 34 in response to a position of selector knob 50. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or memory elements such as, for example, electrically erasable, programmable read only memory (EEPROM).

Figure 3:
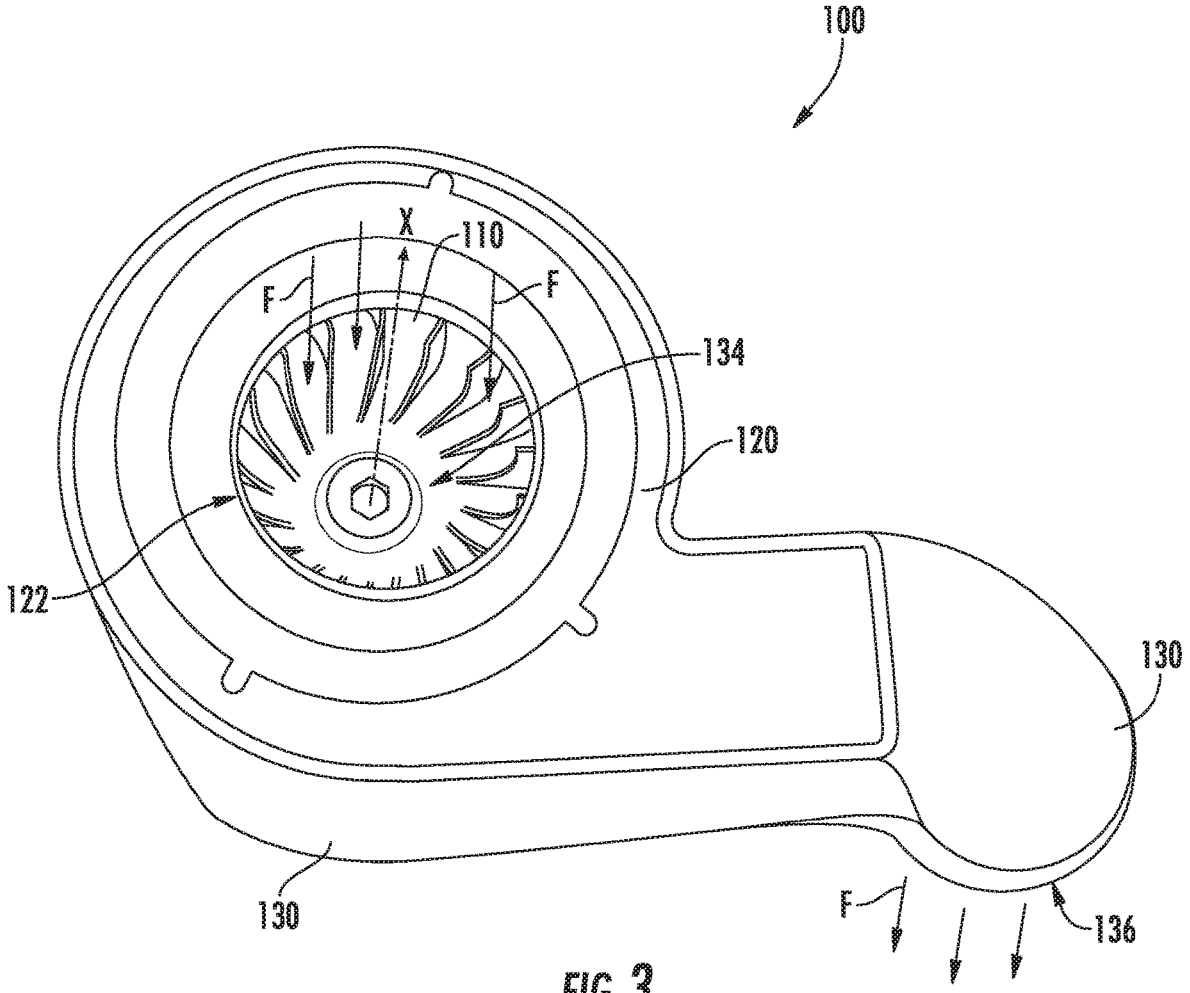
FIG. 3 provides a perspective view of an impeller and housing of a ventilation assembly for a dryer appliance according to exemplary embodiments of the present disclosure.
Figure 4:
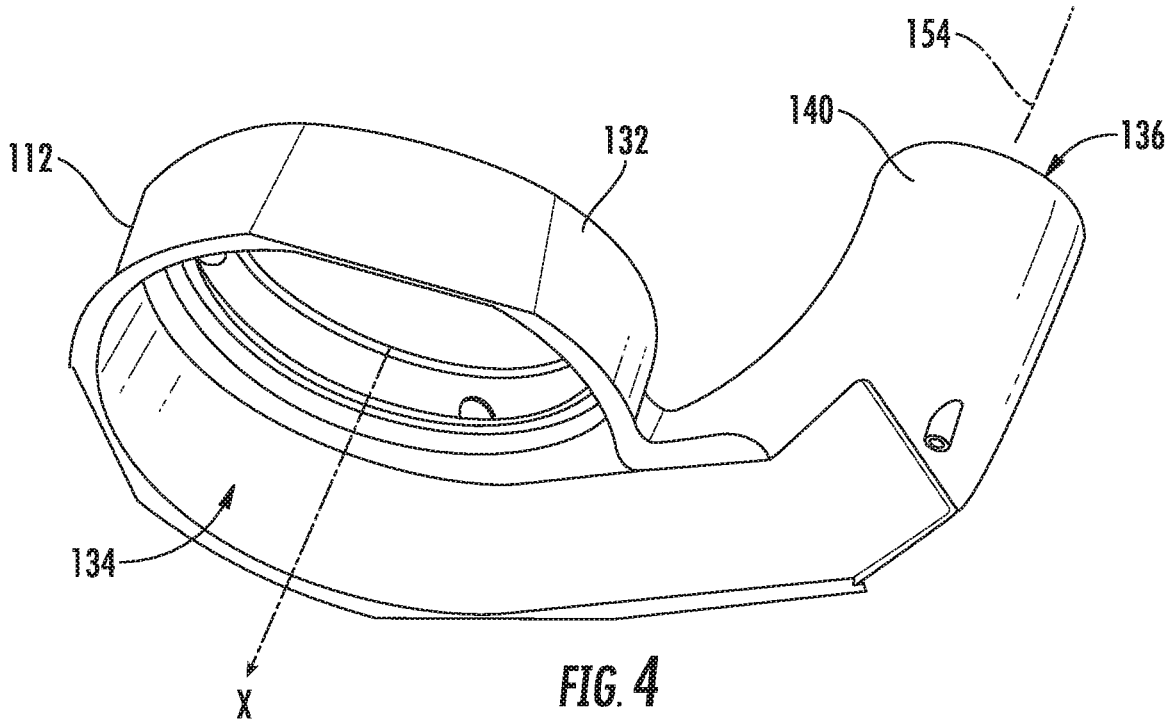
FIG. 4 provides a perspective view of the housing for the impeller of FIG. 3.
Figure 5:
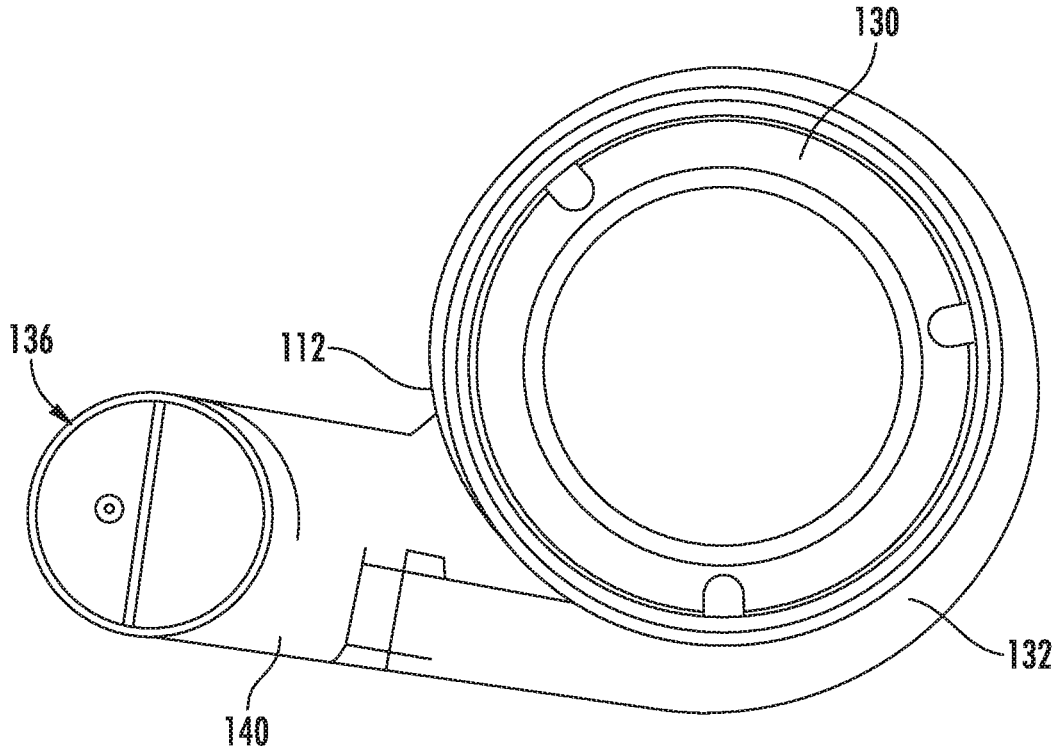
FIG. 5 provides a rear, elevation view of the housing for the impeller of FIG. 3.
Figure 6:
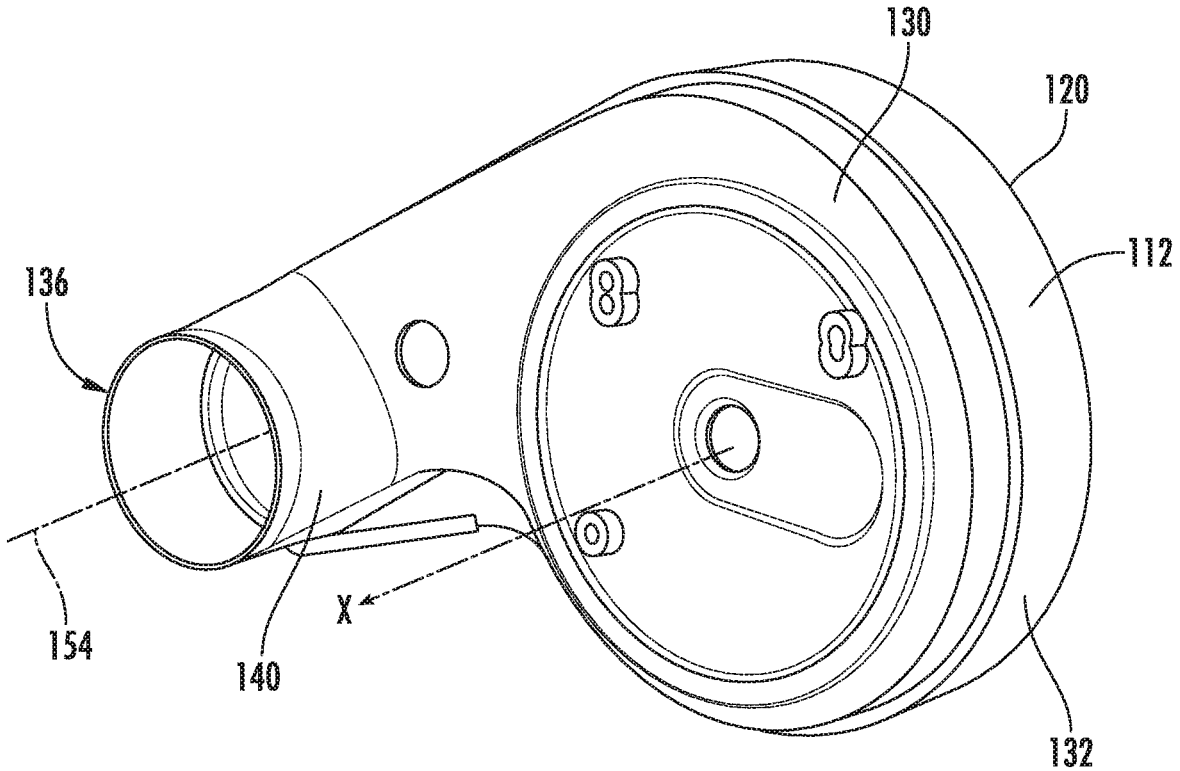
FIG. 6 provides a rear, perspective view of the housing for the impeller of FIG. 3.
Figure 7:
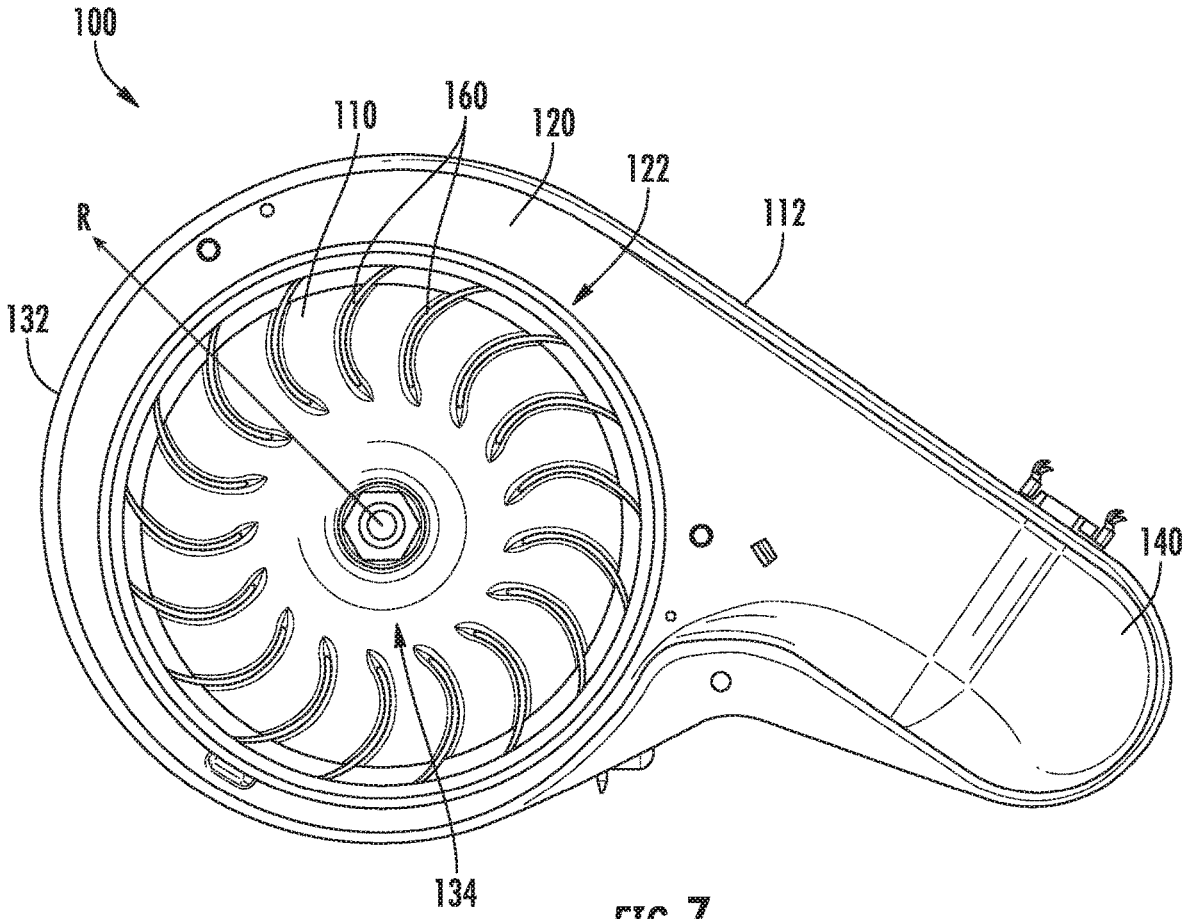
FIG. 7 provides a front, elevation view of the housing for the impeller of FIG. 3.
Figure 8:
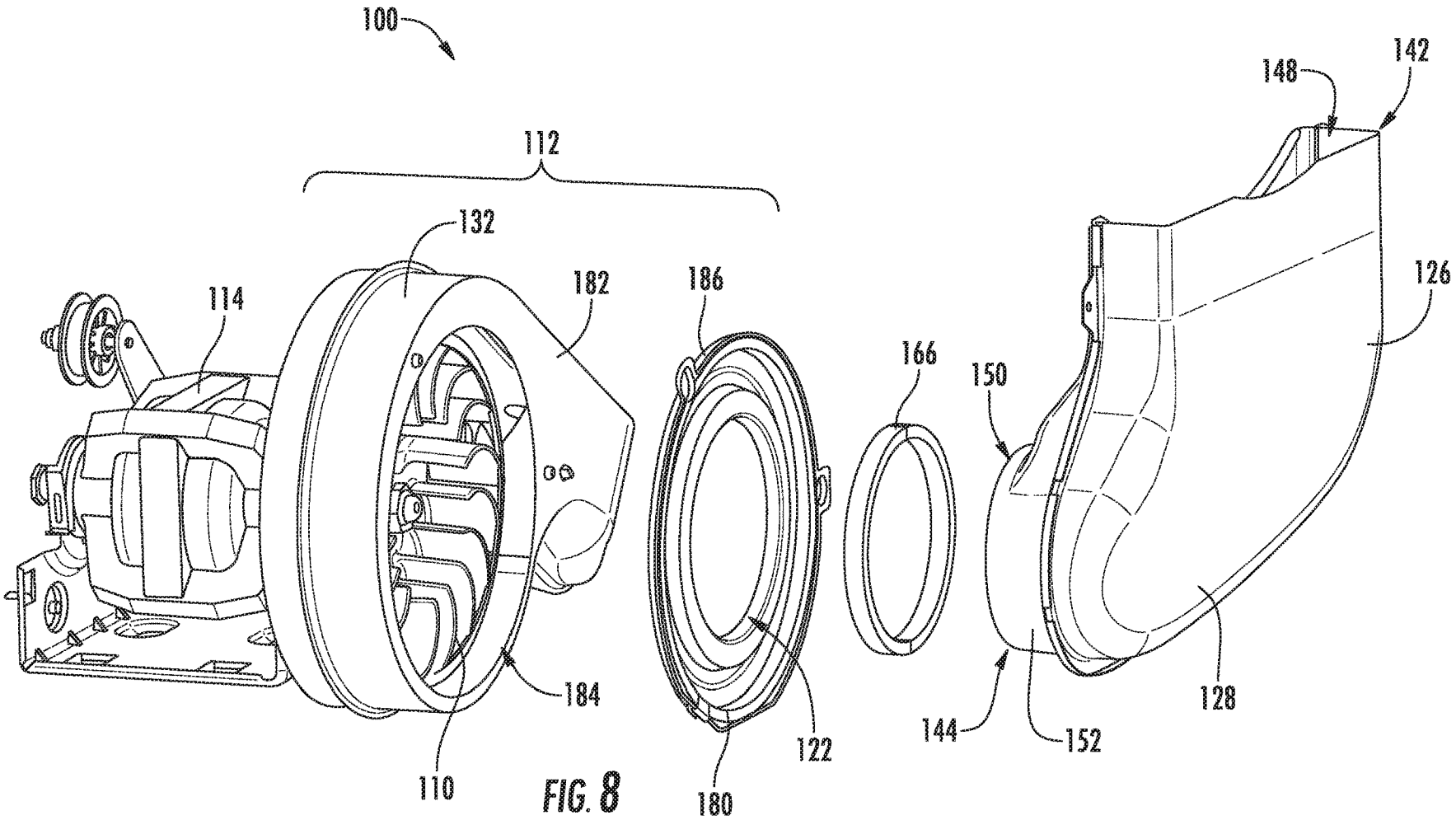
FIG. 8 provides an exploded, perspective view of a portion of a ventilation assembly according to exemplary embodiments of the present disclosure.
Figure 9:
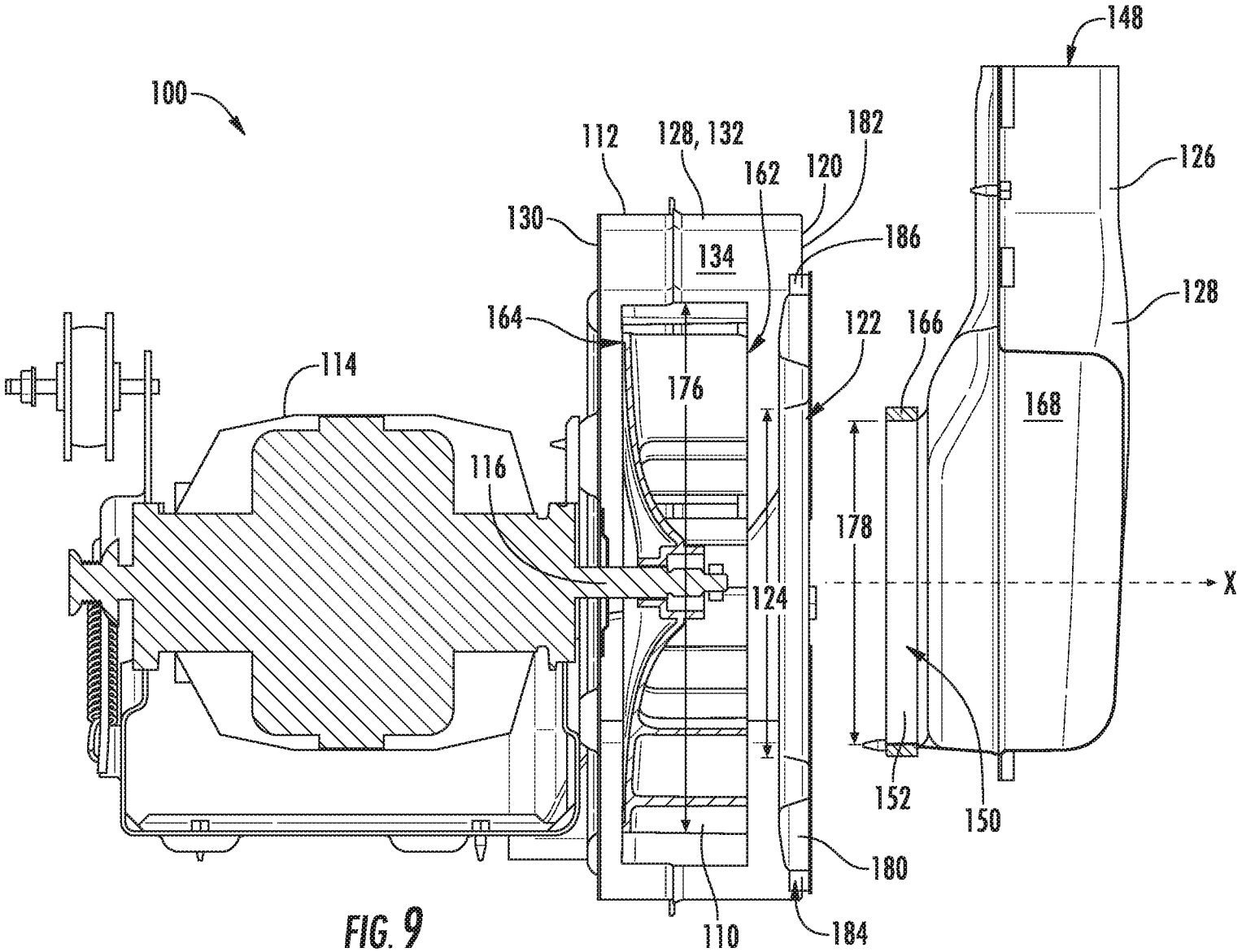
FIG. 9 provides a partially-exploded, sectional view of a portion of a ventilation assembly according to exemplary embodiments of the present disclosure.
Figure 10:
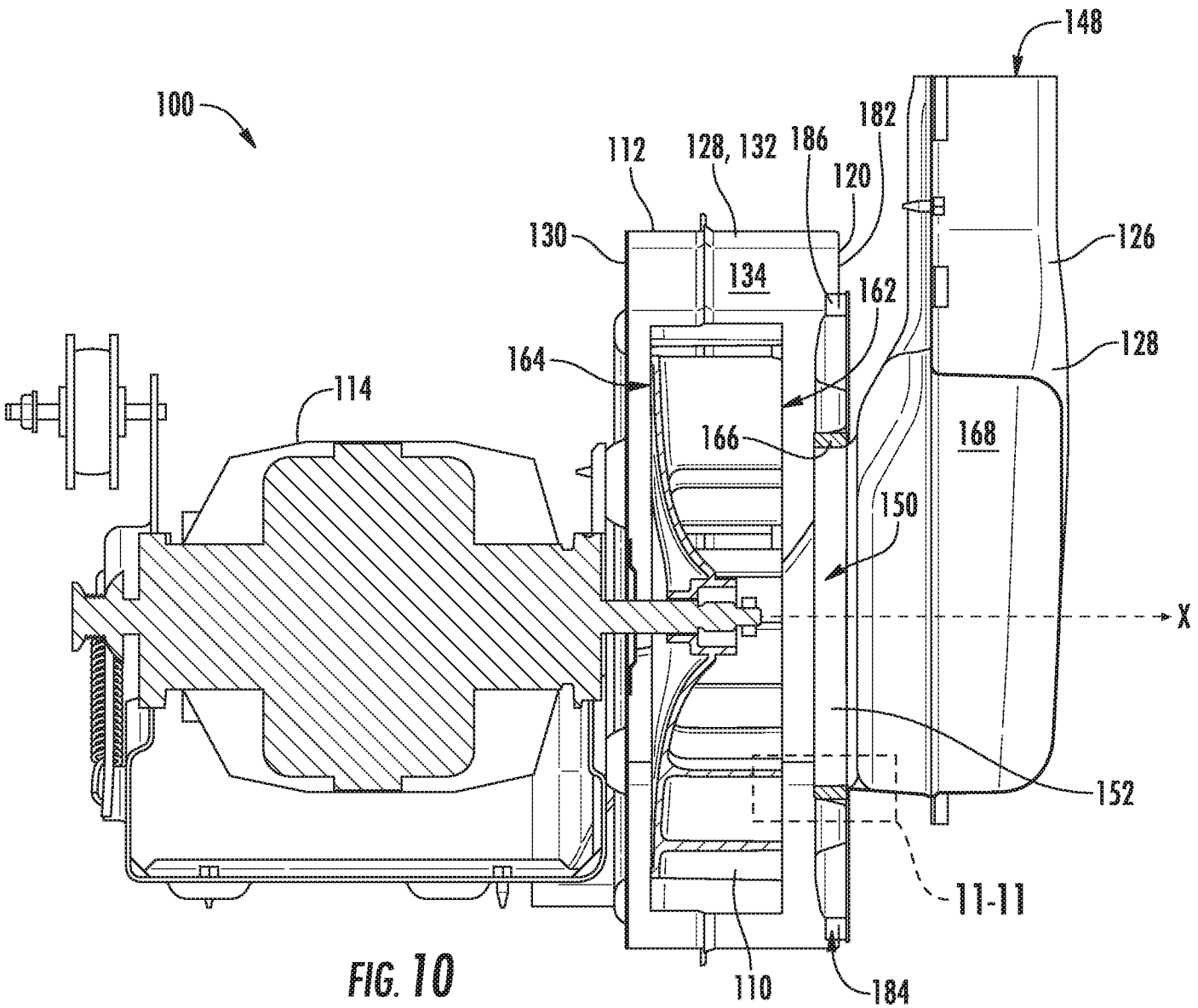
FIG. 10 provides a sectional view of a portion of a ventilation assembly according to exemplary embodiments of the present disclosure.

FIG. 3 provides a perspective view of portions of a ventilation assembly 100 according to exemplary embodiments of the present disclosure. In particular, FIG. 3 illustrates an impeller 110 and a housing 112 of ventilation assembly 100. Generally, ventilation assembly 100 may be used in any suitable appliance. For example, ventilation assembly 100 may be used in dryer appliance 10—FIG. 2. Impeller 110 and housing 112 may be formed as or as part of air handler 42—FIG. 2. Thus, ventilation assembly 100 may be positioned within cabinet 12 such that impeller 110 draws and receives moisture laden air $A_m$ from chamber 27 of drum 26—FIG. 2.

In some embodiments, impeller 110 is positioned within a housing cavity 134 defined by housing 112. In some such embodiments, housing 112 includes a front panel 120 and a rear panel 130 (e.g., at least partially defining the housing cavity 134). When assembled, the front panel 120 and the rear panel 130 may be spaced apart (e.g., along an axial direction X by the housing cavity 134). Additionally or alternatively, impeller 110 may be placed in mechanical communication with a motor 114 (e.g., provided as or as part of the motor 114) that selectively rotates impeller 110 about an axial direction X within housing 112. For example, impeller 110 may be fixed to a shaft or drive rod 116 of motor 114 such that impeller 110 rotates about the axial direction X within housing 112 with motor 114. In some embodiments, the drive rod 116 extends (e.g., along an axial direction X) from the motor 114 to the impeller 110 through the rear panel 130. Opposite from the drive rod 116, the motor 114 may be in mechanical communication with the drum 26 (e.g., via one or more pulleys, as described above).

As shown, front panel 120 is mounted to rear panel 130 (e.g., via one or more sidewalls positioned about or at least partially defining the housing cavity 134). Front panel 120 defines an entrance 122 for receiving the flow of air F (e.g., moisture laden air) into housing 112. In some embodiments, rear panel 130 also defines an exhaust exit 136 for directing the flow of air F out of housing cavity 134. As an example, during operation of ventilation assembly 100, impeller 110 may rotate on the axial direction X within housing 112 such that impeller 110 draws the flow of air F into housing 112 via entrance 122 of front panel 120. In addition, impeller 110 may urge the flow of air F through rear panel 130 to exhaust exit 136 of housing 112 during operation of ventilation assembly 100. In such a manner, impeller 110 may urge or draw the flow of air F through housing 112 during operation of ventilation assembly 100.

Turning now to FIGS. 4 through 7, various views are provided of housing 112. In some embodiments, housing 112 includes a cylindrical portion 132 and a transition duct 140. Cylindrical portion 132 defines a portion of housing cavity 134 (e.g., as a volute) of housing 112 that is sized and configured for receiving impeller 110. Thus, impeller 110 may be positioned within cylindrical portion 132 (e.g., at the volute portion of housing cavity 134). Transition duct 140 extends between cavity 134 of cylindrical portion 132 and exhaust exit 136 (e.g., in an L-shape). Exhaust exit 136 defines an exit axis 154. The flow of air F exits housing 112 at exhaust conduit 136 flowing along a direction that is parallel to exit axis 154. In optional embodiments, exit axis 154 is substantially parallel to the axial direction X. The flow of air F may flow into housing 112, flowing along a direction that is parallel to the axial direction X. Within cavity 134 of cylindrical portion 132, the flow of air F may be urged radially outward from the axial direction X (e.g., perpendicular to the axial direction X). Transition duct 140 may redirect or turn the flow of air F within housing 112 (e.g., such that the flow of air F enters and exits housing 112 along directions that are parallel to each other).

As discussed above, housing 112 may be positioned within cabinet 12 of dryer appliance 10—FIG. 2. As an example, housing 112 may be positioned within cabinet 12 at a front duct (e.g., front duct 126—FIG. 2). Entrance 122 of front panel 120 may be positioned for receiving moisture laden air (e.g., Am—FIG. 2) from the front duct 126. In addition, front panel 120 (FIG. 3) may be mounted to cylindrical portion 132 and positioned over the volute of housing cavity 134. Entrance 122 of front panel 120 may also be positioned for directing the flow of air F into cavity 134 of cylindrical portion 132. The flow of air F flows through housing 112 from cavity 134 of cylindrical portion 132 to exhaust exit 136. From exhaust exit 136, the flow of air F exits housing 112. In dryer appliance 10, exhaust duct 48 may extend between and fluidly couple exhaust exit 136 of housing 112 and vent 49 of cabinet 12—FIG. 2.

Turning now to FIGS. 8 through 11, various additional views are provided of ventilation assembly 100. In particular, a front duct 126 is shown in relation to impeller 110, housing 112, and motor 114. As noted above, ventilation assembly 100 may be used in any suitable appliance, such as dryer appliance 10—FIG. 2. Front duct 126 may be included as or as part of front duct 126—FIG. 2.

In some embodiments, front duct 126 includes a primary body 128 that extends from an upstream end 142 (e.g., proximal to drum 26—FIG. 2) to a downstream end 144 (e.g., proximal to housing 112). A duct inlet 148 may be defined at upstream end 142 (e.g., to receive filter screen 45—FIG. 2), while a duct outlet 150 is defined at downstream end 144. Between duct inlet 148 and duct outlet 150, primary body 128 defines a duct cavity 168 through which moisture laden air (e.g., $A_m$—FIG. 2) may be directed as it flows to housing 112.

At downstream end 144, front duct 126 may include an attachment collar 152 that is received (e.g., selectively received) within entrance 122. As shown, attachment collar 152 may define an outer collar diameter 178 that is smaller than an inner diameter 124 of entrance 122. Moreover, the shape defined by attachment collar 152 (e.g., cylindrical shape) may define a profile perpendicular to the axial direction X that generally complements the shape defined by entrance 122 (e.g., circular shape). In some embodiment, the assembled attachment collar 152 is coaxial with impeller 110 (e.g., about axial direction X). A direct axial flow path may thus be defined for air flowing from front duct 126 to impeller 110.

In certain embodiments, a sealing gasket 166 is positioned between the attachment collar 152 and the entrance 122. Specifically, sealing gasket 166 is radially positioned outward (i.e., further along the radial direction R perpendicular to axial direction X) from the attachment collar 152 and radially inward from at least a portion entrance 122. The path of moisture laden air from front duct 126 to housing 112 may thus be unimpeded by sealing gasket 166.

In some embodiments, sealing gasket 166 forms an airtight or hermetic seal between front duct 126 and housing 112. Optionally, sealing gasket 166 may be fixed (e.g., by a suitable adhesive or mechanical connector) to an outer surface 172 of attachment collar 152. Thus, during assembly of ventilation assembly 100, front duct 126 and sealing gasket 166 may be moved in tandem relative to housing 112.

As is understood, sealing gasket 166 may be formed from any suitable flexible or elastic material (e.g., a natural polymer, synthetic polymer, felt, etc.).

Figure 11:
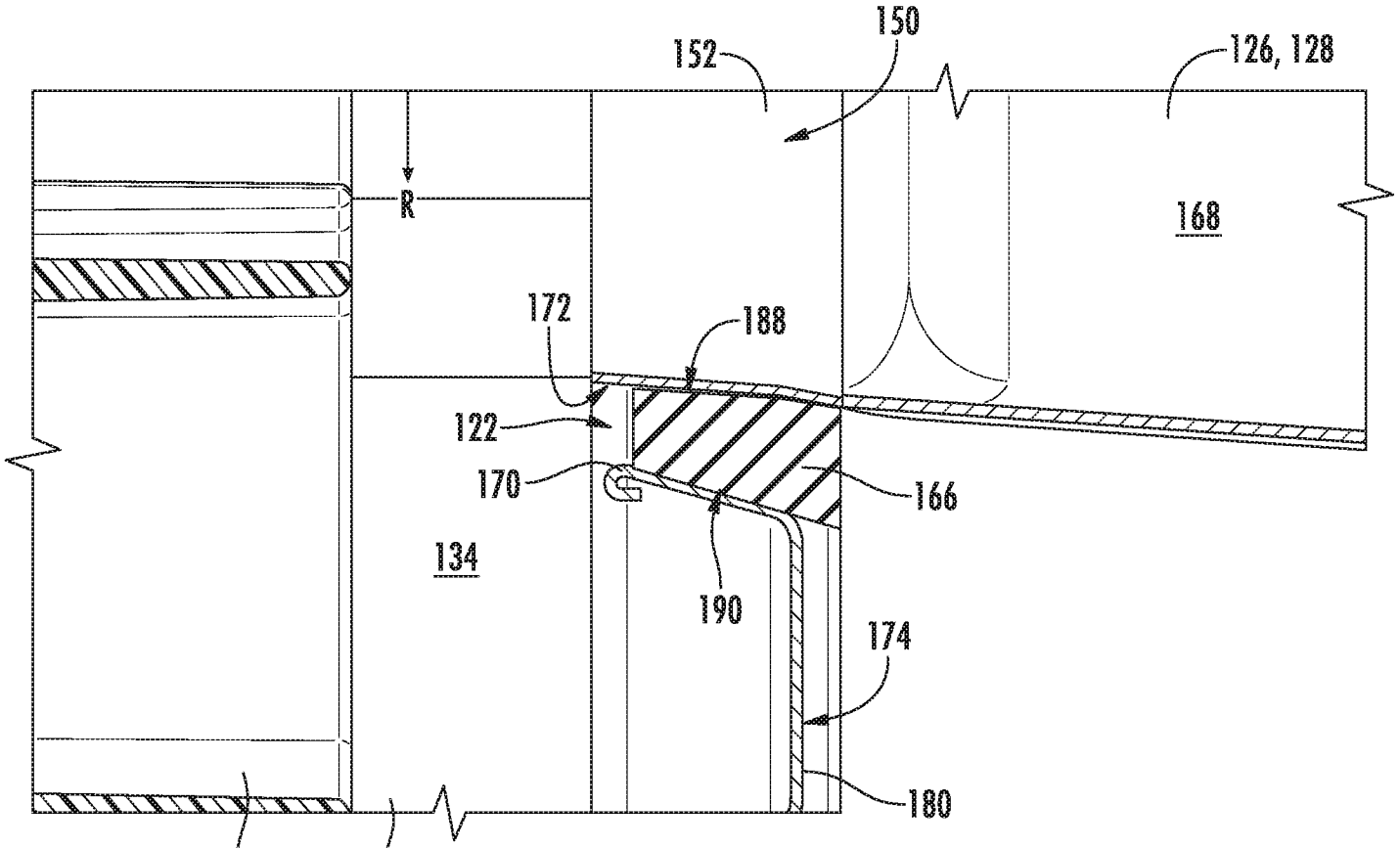
FIG. 11 provides a magnified, sectional view of the segment 11-11 of FIG. 10.

Turning especially to FIG. 11, the exemplary axial sectional profile illustrates the interaction or interface between entrance 122, sealing gasket 166, and attachment collar 152. In some embodiments, attachment collar 152 extends along an outward taper toward the axial direction X within entrance 122. In other words, along a path into entrance 122 from the rest of front duct 126 (e.g., an outward extending path relative to duct cavity 168), the diameter or profile of attachment collar 152 may decrease with proximity to impeller 110. Optionally, an inner surface 188 of sealing gasket 166 may complement the outward taper of attachment collar 152. In additional or alternative embodiments, entrance 122 is defined by an inner lip 170 that extends along an inward taper toward the axial direction X. In other words, inner lip 170 may extend along a path from an outer surface 174 of housing 112 into the housing cavity 134 (e.g., inward-extending path relative to housing cavity 134), the diameter or profile of inner lip 170 may decrease with proximity to impeller 110. Optionally, an outer surface 190 of sealing gasket 166 may complement the inward taper of entrance 122.

Advantageously, sealing gasket 166 may improve assembly and ease insertion/guidance of front duct 126 into housing 112 (e.g., during construction of dryer appliance 10—FIG. 2).

In optional embodiments, housing 112 includes an inlet cover 180 that is selectively or removably mounted to cylindrical portion 132. For instance, at least a portion of front panel 120 may include inlet cover 180, which is in turn selectively mounted to a stationary panel 182. As shown, inlet cover 180 may define entrance 122. When assembled, sealing gasket 166 may thus be positioned in contact (e.g., direct contact) with both attachment collar 152 and inlet cover 180. Stationary panel 182 may define an axial opening 184 that inlet cover 180 spans or is received within (e.g., when inlet cover 180 is mounted to cylindrical portion 132).

In some such embodiments, a secondary gasket 186 is radially positioned between inlet cover 180 and the axial opening 184. When assembled, secondary gasket 186 may form an air-tight or hermetic seal between stationary panel 182 and inlet cover 180. Air drawn into cylindrical portion 132 may thus be forced through entrance 122.

Returning generally to FIGS. 3 through 11, in exemplary embodiments, the impeller 110 is a centrifugal impeller 110 configured to rotate about the axial direction X. Multiple vanes 160 may be provided on the impeller 110 and may extend generally outward in or along a radial direction R that is perpendicular to the axial direction X. For example, the vanes 160 may extend parallel to the radial direction R or, alternatively, along a generally-radial arcuate path (as shown). In optional embodiments, the impeller 110 has an open face 162 (e.g., directed toward the front panel 120 or entrance 122) and a closed face 164 (e.g., directed toward the rear plate 130). As shown, the vanes 160 may thus extend axially from a supported end at the closed face 164 to a free end at the open face 162. In other words, the vanes 160 may be formed on or attached to baseplate defining the closed face 164 while being at least partially unsupported or uncovered at the open face 162. Although the vanes 160 may be unsupported or uncovered at the open face 162, a bracing rim (not pictured) may extend across the vanes 160 at the free end (e.g., across less than 80% of the area of the circular profile of the impeller 110 at the open face 162) in order to maintain rigidity and circumferential spacing between the vanes 160. When assembled, the open face 162 may be positioned proximal to the front panel 120 and distal to the rear panel 130, while the closed face 164 is proximal to the rear panel 130 and distal to the front panel 120. Thus, as the impeller 110 rotates, air may be drawn axially toward the open face 162 before being directed radially outward at or across the closed face 164.

In exemplary embodiments, the impeller 110 has or defines a circular perimeter. The impeller 110 may thus provide a generally circular profile (e.g., as defined on a plane perpendicular to the axial direction X). Across the circular perimeter (e.g., perpendicular to the axial direction X), the impeller 110 extends to an outer impeller diameter 176. As shown, the outer impeller diameter 176 may be defined as a radially-outermost portion of the impeller 110 (e.g., outermost as measured from the axial direction X). In some such embodiments, the outer impeller diameter 176 is defined at a radial tip or perimeter of the vanes 160 or closed face 164. In certain embodiments, the outer impeller diameter 176 is greater than an inner diameter 124 defined by the entrance 122. Optionally, the axial opening 184 may define an inner opening width or diameter that is greater than the outer impeller diameter 176. During assembly, impeller 110 may thus be inserted into housing 112 through axial opening 184 before inlet cover 180 is mounted to cylindrical portion 132.

Advantageously, ventilation assemblies, as described herein may prevent air leaks (e.g., of moisture laden air passing from a drum of a dryer appliance) while an impeller motivates an air flow. In particular, the area proximal to and upstream from an impeller may be particularly sealed. Moreover, the disclosed subject matter may advantageously provide a front duct that may be readily or easily moved relative to an impeller housing, which may in turn along the front duct to be mounted separately from the impeller housing within a cabinet of a dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining a vent;

a drum rotatably mounted within the cabinet, the drum defining a chamber for receipt of articles for drying;

an impeller rotatable about an axial direction to urge a flow of air from the chamber of the drum to the vent of the cabinet;

a housing enclosing the impeller within the cabinet, the housing defining an entrance upstream of the impeller to permit air into the housing;

a front duct extending along a flow path between the drum and the housing, the front duct comprising an attachment collar defining a duct outlet, the attachment collar being received within the entrance; and a sealing gasket radially positioned between the attachment collar and the entrance, wherein the housing comprises a cylindrical portion defining volute within which the impeller is enclosed, and an inlet cover mounted to the cylindrical portion, the inlet cover defining the entrance, wherein the cylindrical portion defines an axial opening within which the inlet cover is received, and wherein dryer appliance further comprises a secondary gasket radially positioned between the inlet cover and the axial opening.

2. The dryer appliance of claim 1, wherein the sealing gasket is fixed to an outer surface of the attachment collar.

3. The dryer appliance of claim 1, wherein the attachment collar is coaxial with the impeller about the axial direction.

4. The dryer appliance of claim 1, wherein the entrance extends along an inward taper toward the axial direction from an outer surface of the housing.

5. The dryer appliance of claim 1, wherein the attachment collar extends along an outward taper toward the axial direction within the entrance.

6. The dryer appliance of claim 1, wherein the housing comprises a transition duct extending between the cylindrical portion and an exhaust exit of the housing.

7. The dryer appliance of claim 1, wherein the impeller is a centrifugal impeller.

8. The dryer appliance of claim 1, further comprising a motor mounted within the cabinet, the motor comprising a drive shaft extending through the housing opposite from the entrance, the drive shaft being in mechanical communication with the impeller to motivate rotation of the impeller about the axial direction.

9. The dryer appliance of claim 8, wherein the motor is further in mechanical communication with the drum to motivate rotation thereof.

10. A dryer appliance, comprising:

a cabinet defining a vent;

a drum rotatably mounted within the cabinet, the drum defining a chamber for receipt of articles for drying;

an impeller rotatable about an axial direction to urge a flow of air from the chamber of the drum to the vent of the cabinet;

a housing enclosing the impeller within the cabinet, the housing defining an entrance upstream of the impeller to permit air into the housing;

a front duct extending along a flow path between the drum and the housing, the front duct comprising an attachment collar defining a duct outlet, the attachment collar being received within the entrance; and a sealing gasket radially positioned between the attachment collar and the entrance, wherein the entrance extends along an inward taper toward the axial direction from an outer surface of the housing, and wherein the housing comprises a cylindrical portion defining volute within which the impeller is enclosed, and an inlet cover mounted to the cylindrical portion, the inlet cover defining the entrance, wherein the cylindrical portion defines an axial opening within which the inlet cover is received, and wherein dryer appliance further comprises a secondary gasket radially positioned between the inlet cover and the axial opening.

11. The dryer appliance of claim 10, wherein the sealing gasket is fixed to an outer surface of the attachment collar.

12. The dryer appliance of claim 10, wherein the attachment collar is coaxial with the impeller about the axial direction.

13. The dryer appliance of claim 10, wherein the attachment collar extends along an outward taper toward the axial direction within the entrance.

14. The dryer appliance of claim 10, wherein the housing comprises a transition duct extending between the cylindrical portion and an exhaust exit of the housing.

15. The dryer appliance of claim 10, wherein the impeller is a centrifugal impeller.

16. The dryer appliance of claim 10, further comprising a motor mounted within the cabinet, the motor comprising a drive shaft extending through the housing opposite from the entrance, the drive shaft being in mechanical communication with the impeller to motivate rotation of the impeller about the axial direction.

17. The dryer appliance of claim 16, wherein the motor is further in mechanical communication with the drum to motivate rotation thereof.

18. A dryer appliance, comprising:

a cabinet defining a vent;

a drum rotatably mounted within the cabinet, the drum defining a chamber for receipt of articles for drying;

an impeller rotatable about an axial direction to urge a flow of air from the chamber of the drum to the vent of the cabinet;

a housing enclosing the impeller within the cabinet, the housing defining an axial opening;

an inlet cover received within the axial opening and defining an entrance upstream of the impeller to permit air into the housing;

a front duct extending along a flow path between the drum and the housing, the front duct comprising an attachment collar defining a duct outlet, the attachment collar being received within the entrance;

a sealing gasket radially positioned between the attachment collar and the entrance; and a secondary gasket radially positioned between the inlet cover and the axial opening.

19. The dryer appliance of claim 18, wherein the attachment collar is coaxial with the impeller about the axial direction.

20. The dryer appliance of claim 18, wherein the attachment collar extends along an outward taper toward the axial direction within the entrance.

* * * * *